US008152662B2

(12) United States Patent
Dill

(10) Patent No.: US 8,152,662 B2
(45) Date of Patent: Apr. 10, 2012

(54) RADIAL BASEBALL BAT

(75) Inventor: Ward A. R. Dill, Chatham, NJ (US)

(73) Assignee: Radial Bat Institute, Inc., Warren, NJ (US)

( * ) Notice: Subject to any disclaimer, the term of this patent is extended or adjusted under 35 U.S.C. 154(b) by 148 days.

(21) Appl. No.: 11/962,156

(22) Filed: Dec. 21, 2007

(65) Prior Publication Data

US 2008/0308187 A1 Dec. 18, 2008

Related U.S. Application Data

(60) Provisional application No. 60/883,079, filed on Jan. 2, 2007.

(51) Int. Cl.
*A63B 59/06* (2006.01)

(52) U.S. Cl. ..... 473/564

(58) Field of Classification Search ..... 473/457, 473/519, 520, 564–568; 144/37
See application file for complete search history.

(56) References Cited

U.S. PATENT DOCUMENTS

| | | | | |
|---|---|---|---|---|
| 292,190 | A | 1/1884 | Williams | |
| 310,248 | A | 1/1885 | Brown | |
| 336,255 | A | 2/1886 | Nichols | |
| 672,646 | A | 4/1901 | Mereness | |
| 795,815 | A | 8/1905 | Burrows | |
| 813,400 | A | 2/1906 | Buehler | |
| 1,549,803 | A | 8/1925 | Rastetter | |
| 1,601,915 | A | 10/1926 | Hillerich | |
| 2,458,919 | A | 1/1949 | Marsden | |
| 3,340,908 | A * | 9/1967 | Crozier | 83/473 |
| D335,314 | S | 5/1993 | Coyle | |
| 5,490,669 | A * | 2/1996 | Smart | 473/564 |
| 6,007,440 | A * | 12/1999 | Bender et al. | 473/564 |
| 6,010,417 | A | 1/2000 | Young et al. | |
| 6,162,128 | A | 12/2000 | McCarty et al. | |
| 6,334,823 | B1 * | 1/2002 | Holman | 473/564 |
| 6,827,659 | B1 | 12/2004 | Chen | |
| D526,034 | S | 8/2006 | Davis et al. | |
| 7,114,419 | B2 * | 10/2006 | Liess | 82/1.11 |
| 2006/0030437 | A1 * | 2/2006 | Bao et al. | 473/564 |
| 2007/0072710 | A1 * | 3/2007 | Lo | 473/564 |
| 2007/0135246 | A1 * | 6/2007 | Davis et al. | 473/564 |
| 2007/0219026 | A1 * | 9/2007 | Lo | 473/564 |

OTHER PUBLICATIONS

"MLB Official Rules", http://mlb.mlb.com/mlb/official_info/official_rules/objectives_1.jsp, last viewed Mar. 18, 2008.
"An All Wood 3-Piece Bat Made from Ash, Hickory & Maple", http://web.archive.org/web/20050718111158/http://www.baseballtips.com/hoosier.html, Web archive Jul. 18, 2007.
"Young 360 Woody Bat", www.baseballtips.com/youngwood.html, last viewed Dec. 14, 2006.
"Mad Dog Bats", www.maddogbats.com/products.html, last viewed Dec. 18, 2007.
Daniel A. Russell, "Bending Modes, Damping, and the Sensation of Sting in Baseball Bats", Author's preprint copy, Mar. 1, 2006.

(Continued)

*Primary Examiner* — Mark Graham
(74) *Attorney, Agent, or Firm* — Venable LLP; Keith G. Haddaway

(57) ABSTRACT

A laminated wood bat having may comprise wedges of wood adhered together in such a manner that the entire surface or sections of the surface of the bat barrel, throat, and handle have the tight grain of the normal hitting surface. Adjacent wedges of wood may be cut from the same strip of wood. The bat may be glued together with a low viscosity polyurethane adhesive.

14 Claims, 11 Drawing Sheets

OTHER PUBLICATIONS

Brendan I. Koerner, "As Laws Change, So Does the Baseball Bat", *The New York Times*, Jul. 1, 2007.
Philipp Harper, "Where Do Baseball Bats Come From?", http://green.msn.com/article/article.aspx?aid=279, Updated: Oct. 24, 2007.
"Technical Data Sheet—PL Premium Polyurethane Construction Adhesive", OSI Sealants Inc. sP20091, Updated Oct. 31, 2003.
"Material Safety Data Sheet, PL® Premium Polyurethane Construction Adhesive", Sep. 20, 2007.
"Gorilla Glue Product Detail", www.gorillaglue.com/home/gorilla-glue/product-detail.aspx, last viewed Dec. 18, 2007.
"Material Safety Data Sheet, Gorilla Glue", Jan. 16, 2007.
"3M Scotch-Weld™ Technical Data", 3M Industrial Business, 78-6900-7074-9, May 2006.

* cited by examiner

RADIAL BASEBALL BAT

CROSS-REFERENCE TO RELATED APPLICATION

This application claims the benefit of the filing date of U.S. provisional patent application Ser. No. 60/883,079, filed Jan. 2, 2007, and entitled "Radial Baseball Bat". Said provisional application is incorporated herein by reference.

FIELD OF THE INVENTION

The invention is in the field of baseball bats.

BACKGROUND

Standard baseball bats include wood baseball bats consisting of a single piece of wood, laminated wood baseball bats comprised of multiple solid sections of wood adhered together, and metal baseball bats. A wood baseball bat requires a greater level of skill to use than a metal baseball bat. However, people who are interested in the integrity of the game of baseball, interested in preparing for entry into the professional baseball leagues where wood baseball bats are the only bats permitted to be used, or who prefer the sound and appearance of a wood baseball bat, seek to find wood baseball bats with the best performance and durability features available.

Major League Baseball (MLB) requires the use of wood bats. These bats do not, however, have to be made of a single piece of wood. The MLB rules committee, for example, has approved a wood bat made of four different pieces of wood, each of a different species, glued together.

There have been recent safety concerns with metal bats. Metal bats have a "trampoline" effect when a ball is hit. The metal deforms and bounces back adding a certain amount of unpredictable direction to the ball. Thus infielders, such as a pitcher or a third baseman, can be injured when a high velocity ball comes off a metal bat with a direction that cannot be readily predicted by observing the bat hit the ball. The infielders are hit before they can react. Thus there is a growing movement among Little League and public school baseball teams to require the use of wooden bats.

Single piece wooden bats, however, have their own safety drawbacks. Single piece wooden baseball bats are vulnerable to breaking into two pieces when a ball is hit. The flying piece of bat can injure a nearby player.

A more subtle safety and comfort issue is a single piece wooden baseball bat will "sting" the hands of a batter when a baseball is struck away from the "sweet spot" of the bat. The stinging causes immediate discomfort and could potentially cause long term injury.

A related drawback of single piece wooden bats is that they are limited to having a relatively high weight for a given length of bat. The weight of a bat relative to its length is given by its "drop number". A drop number is equal to the length of a bat in inches minus its weight in ounces. A 30 inch long bat weighing 27 ounces, for example, has a drop number of 3.

Metal bats designed for children, such as those playing in Little League, will have a drop number as high as 10. The high drop number means that the bat is relatively light for its given length and therefore will be easier for a child to swing. It is difficult to make a single piece wooden bat with a drop number greater than 5. To do so would result in a bat that is too thin and prone to breakage.

Various designs of laminated wooden bats have been proposed to address some of these limitations. Laminated wooden bats comprise bats made from two or more pieces of wood that are adhered together, such as by using glue.

U.S. Pat. No. 813,400 to Buehler, for example, describes a baseball bat made from longitudinal segmental sections of wood glued together. Buehler teaches that the grain of at least some of the sections must be oriented so that it is substantially at right angles to the corresponding tangents of the bat. This unfortunately leads to a substantial amount of wasted stock due to the manner in which the segments must be cut from the original pieces of wood so that the grain in each piece has the proper orientation. Buehler contemplates recovering some of the wasted stock by incorporating it into a bat with the grain parallel to the corresponding tangents instead of at right angles to them (Buehler FIG. 7, item 4), but he concedes that this is an inferior result.

U.S. Pat. No. 2,458,919 to Marsden describes a laminated bat where segments are glued to an axial reinforcing rod subject to the restriction that the grain is approximately radial along the entire length of the bat. This also results in wasted stock for the same reasons as Buehler. The central reinforcing rod may also substantially alter the hitting characteristics of the bat.

Thus there is a need for a method of constructing a laminated bat such that wood is efficiently used given the natural variations in wood grain of the stock. There is also need for a wood bat that can be made with a drop number in the range of 5 to 12 without resulting in breakage of the bat into two or more pieces upon failure.

SUMMARY OF THE INVENTION

The Summary of the Invention is provided as a guide to understanding the invention. It does not necessarily describe the most generic embodiment of the invention or all species of the invention disclosed herein.

The present invention comprises an improved method for manufacturing a laminated wooden baseball bat. Said method produces a bat that is stronger than conventional single piece wooden bats, has a larger effective hitting area (i.e. sweet spot), does not break into two pieces when it fails, has a surprising absence of sting when hit out of the sweet spot, and can be made with a relatively high drop number that is comparable to the drop numbers for metal bats designed for children. Said method also uses wood stock very efficiently and can tolerate a surprisingly large variation in grain orientation.

In one embodiment of the invention, standard dimension planks are cut into strips with widths equal to or greater than the desired radius of the finished bat. The strips are then cut in half lengthwise on a diagonal. This produces a set of wedges with right triangle cross sections. The pairs of wedges from each strip are matched up back to back and a set of matched wedges are glued together to form a billet with a polygonal cross section. The billet is then turned on a lathe to either produce a cylindrical billet suitable for further processing, or produce the final form of the bat. The bat is then sanded and finished with a water resistant finish that still allows the actual wood of the bat to contact the ball with a ball is hit. Tung oil is a suitable finish. Suitable woods for the bat include maple, hickory, ash and other woods of similar physical properties.

DETAILED DESCRIPTION

The following detailed description discloses various embodiments and features of the invention. These embodiments and features are meant to be exemplary and not limiting.

Figure 1:
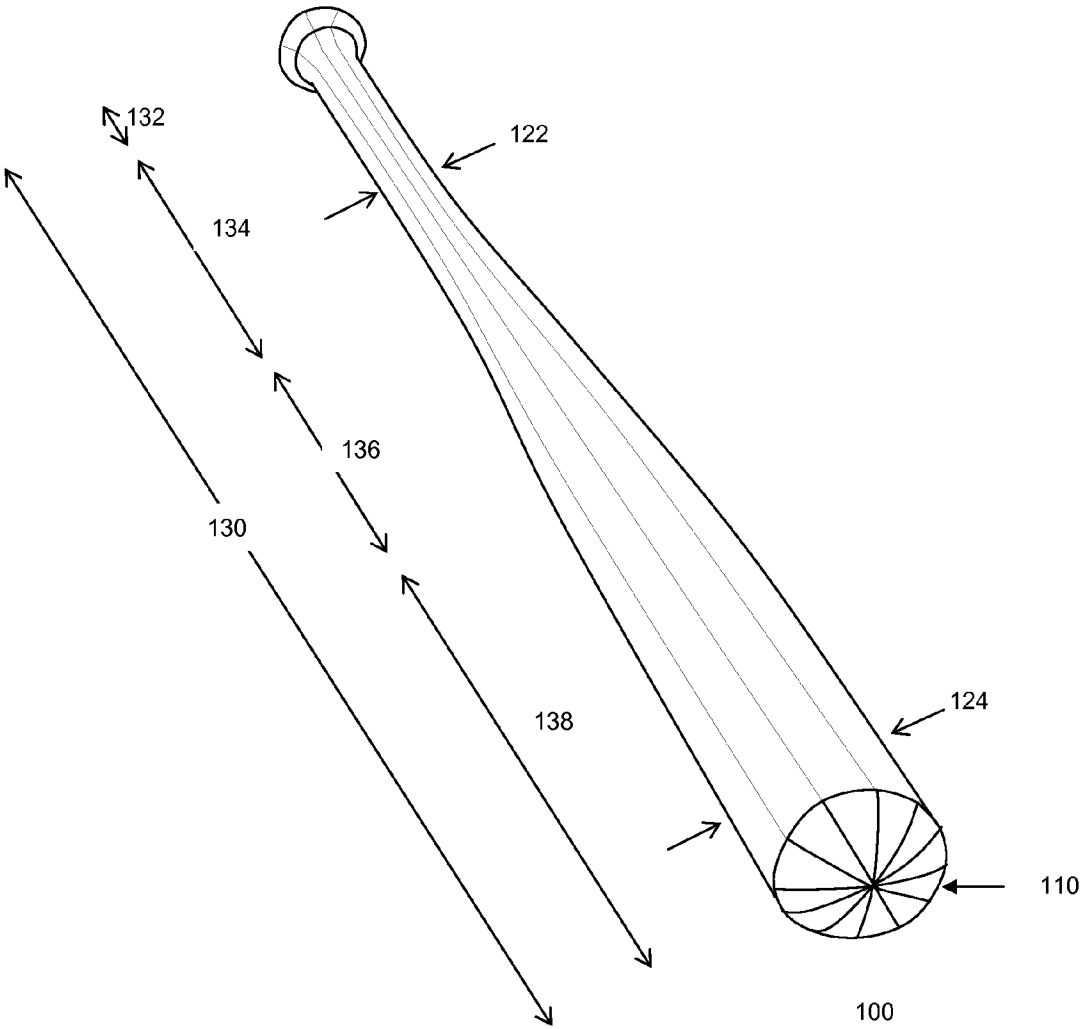
FIG. 1 is a perspective view of a finished bat.

FIG. 1 illustrates an exemplary embodiment of the present invention. A perspective view of a laminated wooden bat 100 is shown. The bat comprises twelve wedges 110 that extend for the length of said bat. The number of wedges may alternatively be in the range of three to 24. An advantage of twelve wedges is that a baseball with contact at least three wedges when struck. This averages out the effects of different orientations in the grain of the hit wedges. It also helps insure shock absorption, structural integrity, and durability.

The bat comprises a knob 132, handle 134, transition region 136 and barrel 138.

The length 130 of the bat may be in the range of 24 inches to 38 inches. The width 122 of the handle may be in the range of ⅞" to 1.25". The width 124 of the barrel may be in the range of 2 to 3 inches. The bat may be made in other shapes and dimensions depending upon the needs of a given player.

A surprising advantage of the construction of the bat is that it can be made with drop numbers as high as 15 without resulting in failure of the bat when a ball is struck with full force in all rotational orientations of the bat.

The wedges of wood may be made out of standard woods used in a bat, such as maple, ash or hickory.

The wood grain in each wedge is oriented so that it is generally normal to the circumference of the bat, but, as will be explained in more detail below, the grain may be oriented such that it is up to 60 degrees from the normal. It has been found that with grains up to 60 degrees from the normal, the exposed grain is still "tight" enough to obtain the benefits of the particular method of construction. Thus commercially available plank stock with normal variations in grain orientation may be used. There should not, however, be any visible knots or other gross defects in the wood.

The wedges need not be single pieces of wood. Multiple pieces joined end to end may be used. This can facilitate high volume production and efficient use of raw materials.

The wedges may be adhered together using glue.

The glue should be able to withstand multiple (e.g. +100) strikes with a full force pitch (e.g. +70 miles per hour) when used to form a bat. Moisture cured polyurethane glues have been found to give acceptable performance. Some brands and models of polyurethane glue have been found to give surprisingly good performance.

OSI Sealants PL Polyurethane Premium Wood Glue is an inexpensive glue that gives suitable results. The properties of said glue are more fully described in "Technical Data Sheet, PL Premium Polyurethane Construction Adhesive", published by OSI Sealants, Inc., publication number sP20091, Oct. 31, 2003. Said publication is incorporated here by reference. It has been found, however, that in some instances handles of bats joined with said OSI glue suffered splitting.

Gorilla brand polyurethane glue gave results superior to that of the OSI glue. The properties of said Gorilla glue are more fully described in "Gorilla Glue Material Safety Data Sheet", published by Gorilla Glue Inc., Jan. 26, 2007. Said publication is incorporated herein by reference. Bats made with said Gorilla glue have not suffered splitting in the handles.

It is believed that the Gorilla glue wet the wood more uniformly when it was applied than the OSI glue and that this accounted for the improved performance. This is consistent with the fact that the published viscosity of Gorilla glue at room temperature is in the range of 4,000 to 7,000 cps. The published viscosity of OSI PL glue at room temperature is in the range of 400,000 to 600,000 cps. Thus the Gorilla glue would noticeably spread and wet the wood when applied, whereas the OSI glue would remain substantially in its original bead shape when applied. The difference in glue performance is surprising given that both glues appear to spread across the wood surfaces when two pieces of wood are clamped together.

Superior results have also been achieved with 3M Scotch-Weld Polyurethane Reactive (PUR) Easy 250 adhesive. The properties of this glue are more fully described in "3M Scotch-Weld™ Polyurethane Reactive Adhesives", published by 3M Industrial Business—Industrial Adhesives and Tapes Division, publication number 78-6900-7074-9, May 2006. Said publication is incorporated herein by reference.

The 3M glue is applied at a temperature of 250° F. and has a set up time of only 30 seconds. It is thus particularly well suited for high speed production methods such as the one described below. The published viscosity of this glue at its application temperature of 250° F. is in the range of 8,400-14,000 cps.

Thus acceptable results can be obtained from using adhesives with viscosities of 600,000 cps or less at their application temperature. Superior results can be obtained using adhesives with viscosities of 14,000 cps or less at their application temperatures.

Figure 2:
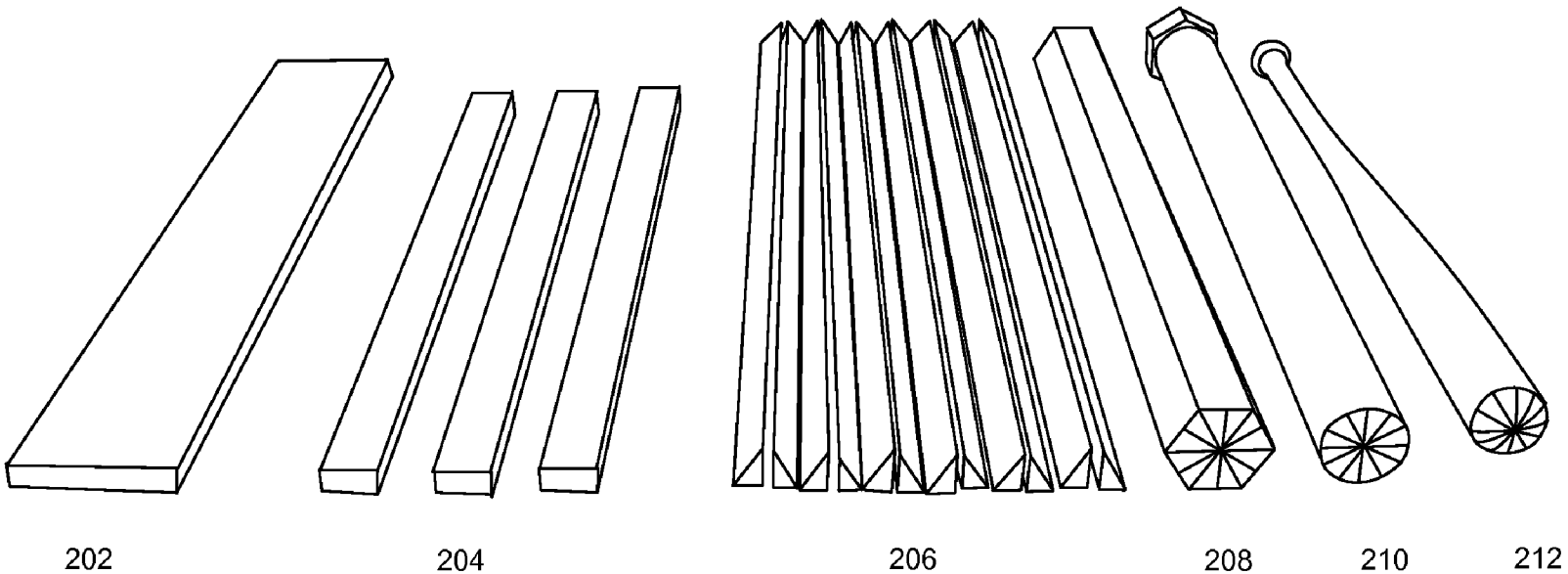
FIG. 2 is a perspective view of bats in various stages of production, starting with an initial plank and ending with a finished bat.

FIG. 2 provides an overview of the bat as it proceeds from initial plank stock to a finished product. The items are shown in perspective.

An initial plank 202 is received from a supplier. The plank has been milled smooth on the top and bottom to give it its desired thickness. A suitable designation for the quality of wood required is "select" or "select without knots". This is sometimes designated at "SEL/BTR" or "SEL & BTR". It may also be designated as "furniture grade".

"Low density" grade is not suitable since the bat will not be hard enough.

"Flaw free" grade is not required. If small flaws are found in a given plank, the section of the plank with the flaws can be selectively discarded after it has been cut into strips as described below.

For the bat shown in FIG. 2, two planks are required.

The planks are cut into strips 204. A single plank, 5.5 inches in width, with yield three strips. Six are strips are required for the bat shown in FIG. 2.

The strips are cut lengthwise along the diagonal to yield two wedges each. One wedge in each pair of wedges is flipped, rotated and matched up back to back with its partner. Six sets of matched wedges 206 are shown. These are enough for a bat.

Each wedge then has glue applied to at least one face and the wedges are then arranged into a hexagonal billet 208 and clamped at least until the glue sets.

The hexagonal billet is then turned on a lathe to form a cylindrical billet 210. The cylindrical billet is then put on a lathe and milled to give it its final shape 212.

Aesthetics are important in wooden bats. A method for giving an aesthetically suitable finish is to sand the final bat to at least 600 grit and then give a final coat of a tung oil.

Figure 3:
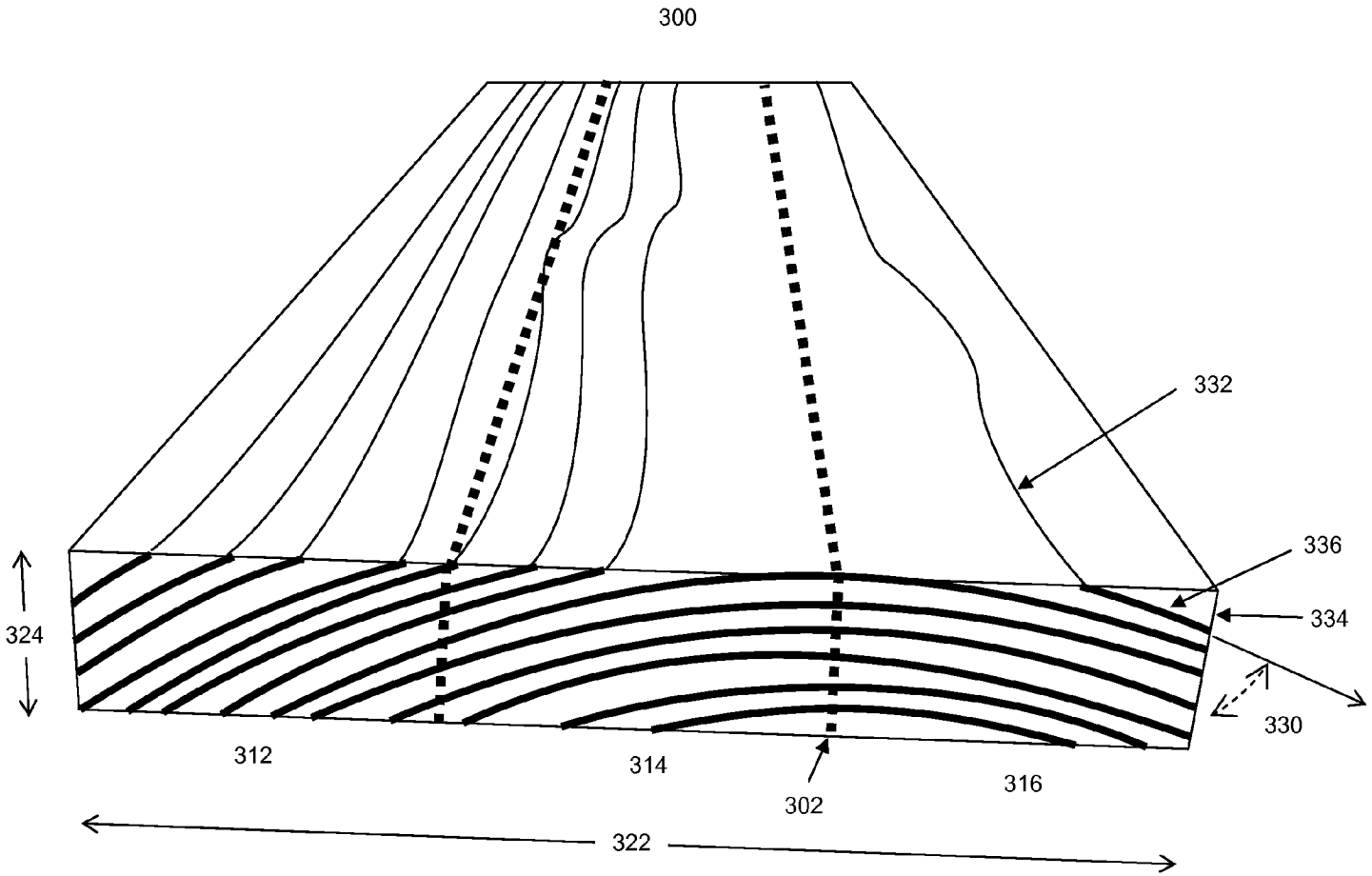
FIG. 3 is a perspective view of a plank of suitable stock showing the naturally occurring grain.

FIG. 3 illustrates the natural variation in grain commonly found in a 5.5" wide (322) by 15/16 inch thick (324) planks 300 of select-without-knots ash. Dotted lines 302 are shown to illustrate how the plank would be cut into 1.75 inch wide strips 312, 314 and 316.

The end grain 336 is shown in relatively thick lines. The face grain 332 is shown in relatively thin lines.

There is a noticeable curvature in the end grain. Thus the average orientation of the grain within a given strip can vary from near horizontal in strips 314 and 316 to distinctly angular in strip 312. The angle 330 with respect of any given edge surface 334 of a strip may vary between 30 degrees (a relatively shallow angle) to 90 degrees. If the angle of the grain with respect to the edge of a given strip is less than 30 degrees, then the strip may be discarded and an alternative strip from another plank may be substituted.

The face grain 332 may also vary significantly from one end of a plank to the other. This is one of the rationales for matching wedges from a given strip.

Figure 4:
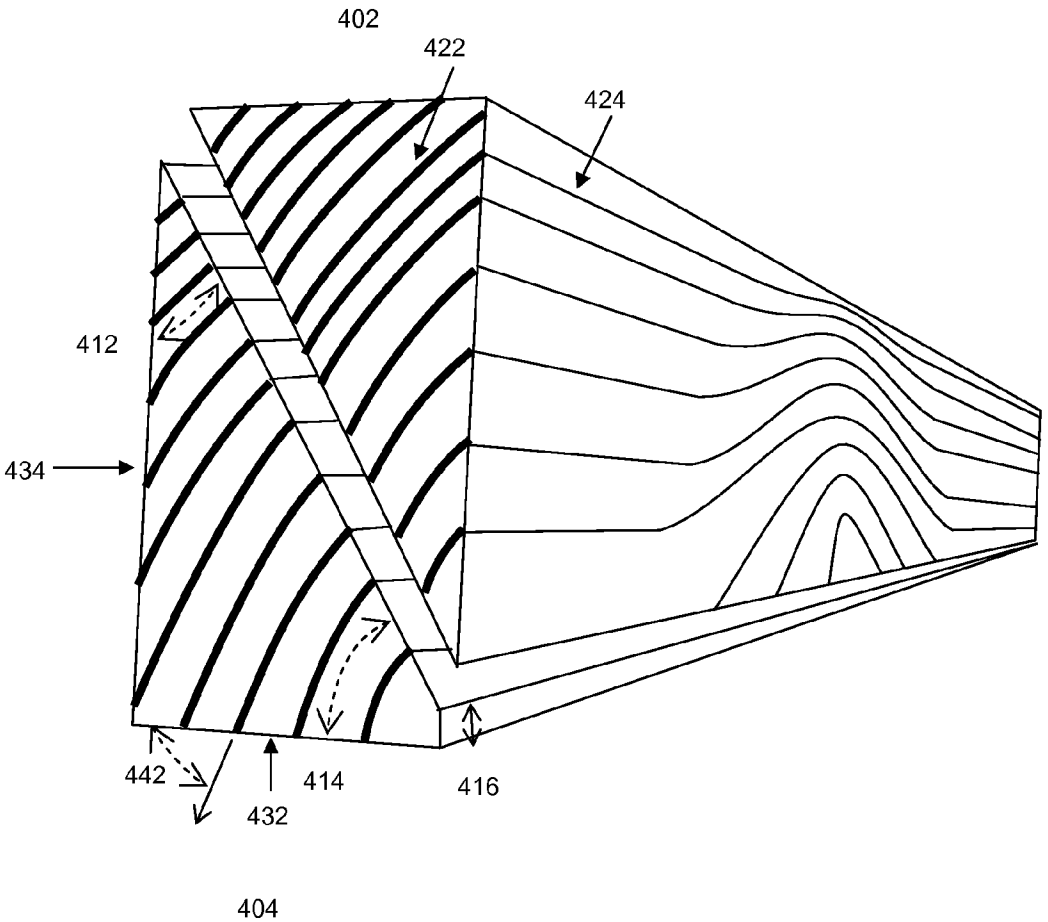
FIG. 4 is a perspective view of a strip that has been cut into two wedges. The naturally occurring grain is shown.

FIG. 4 shows a perspective view of a first wedge 402 and a second wedge 404 cut from a single strip. The minor angle 412 of the wedge right triangle cross section is 30 degrees. The major angle 414 is 60 degrees. The face of a wedge opposite said minor angle is the minor face 432. The face of a wedge opposite said major angle is the major face 434. As indicated above, the angle 442 of the end grain with respect to the minor face of a wedge should be 30 degrees or greater.

A certain amount of miscut 416, such as 1/8 inch, is acceptable.

Actual end grain 422 and face grain 424 from an exemplary strip is shown to illustrate allowable variations in both.

Wedges with other angles may be cut for strips that have been appropriately dimensioned. Thicker strips with a square cross section, for example, may be cut with the major and minor angles both equal to about 45 degrees. This would yield a square shape billet with 8 wedges. Alternatively, thinner strips might be cut at a shallower minor angle. If the minor angle is 23.5 degrees, then a 16 wedge octagonal billet would result.

Figure 5:
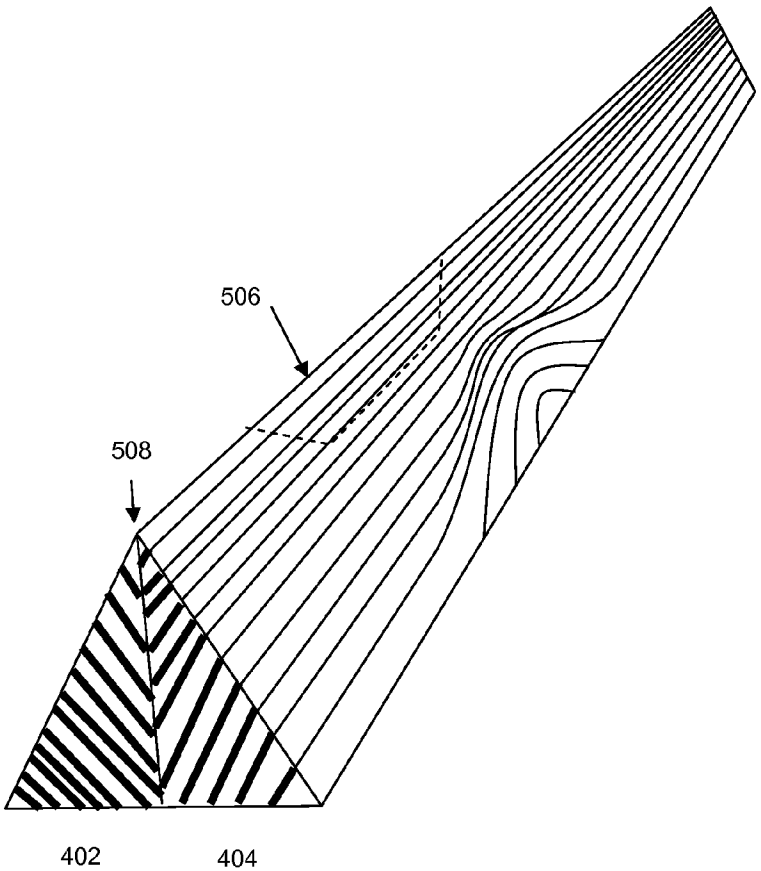
FIG. 5 shows the two wedges of FIG. 4 matched up back to back.

FIG. 5 shows wedges 402 and 404 matched up back-to-back. In order to match two wedges back-to-back, one of the wedges has to be flipped lengthwise so that the back end grain of one wedge is adjacent to the front end grain of another. The grain matching, therefore, is not perfect due to variations in grain orientation along the length the wedges.

FIG. 5 also shows that a portion 506 of the vertices 508 of the wedges may be optionally removed. This would allow for lower weight (i.e. higher drop number) bats to be made without requiring unduly small external diameters. This can also be used to adjust the position of the center of the mass of a bat.

Figures 6A, 6B:
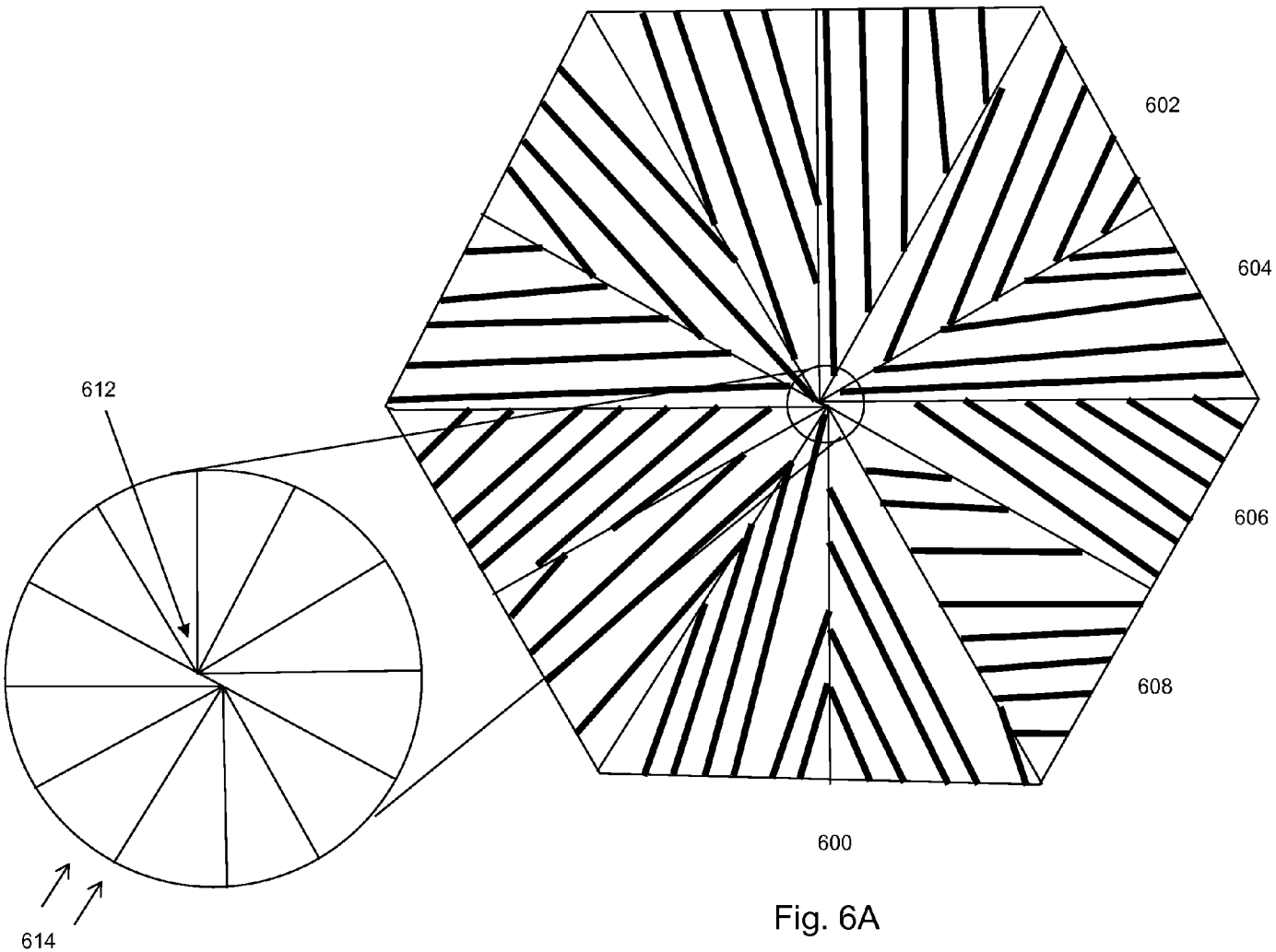
FIG. 6A shows the cross section of a billet made up of twelve wedges glued together. An acceptable range of grain orientations for matched wedge pairs is shown.
FIG. 6B shows a magnification of the center of FIG. 6A illustrating an aesthetically acceptable range of mismatch in wedge vertices in the final billet.

FIG. 6A shows the end grain of an exemplary hexagonal billet 600 made by the above described process. Most of the wedge pairs, such as 602 and 604 have well matched grains. Some of the wedge pairs, such as 606 and 608 have less well matched end grains. Suitable performance and cosmetics are nonetheless achieved.

FIG. 6B is a magnification of the center of FIG. 6A showing an acceptable amount of mismatch in the vertices 612 of the wedges. Half of the vertices are offset from the other half by a small amount 614. This may be due to normal tolerances in manufacturing. A mismatch of up to 10 thousandths of an inch is considered acceptable from an aesthetic standpoint. Mismatches of no more than 4 thousandths are preferred.

Figure 7:
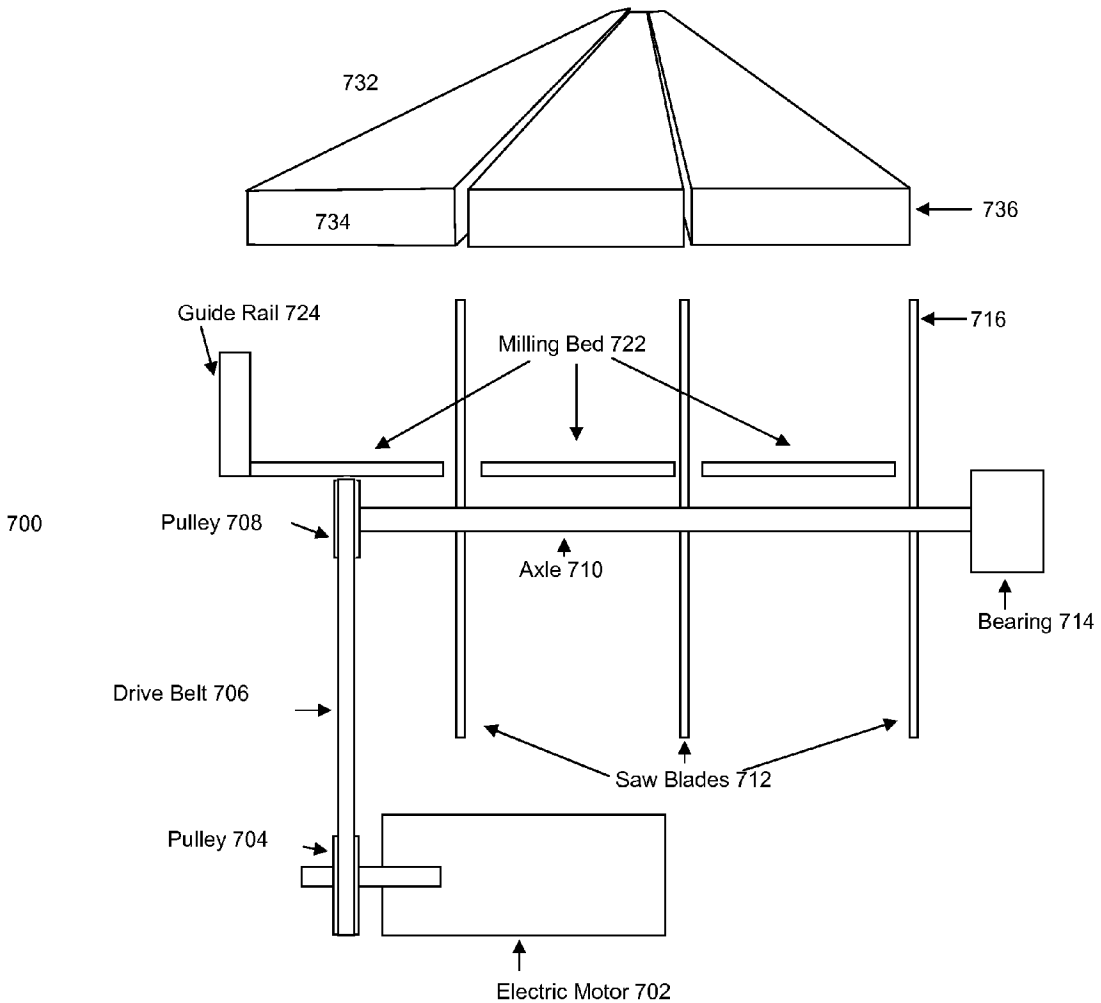
FIG. 7 shows a front view of a suitable saw apparatus for cutting a typical plank stock into strips.

FIG. 7 illustrates exemplary sawing equipment 700 that can be used for mass production of the billets and bats described herein. The sawing equipment comprises an electric motor 702, first pulley 704, drive belt 706, second pulley 708, axle 710, three circular saw blades 712 and bearing 714.

The circular saw blades are preferably carbide tipped ripping blades.

The saw additionally comprises milling bed 722, guide rail 724 and appropriate guards and other safety equipment (not shown).

In order to cut a plank 732 into strips 734, the plank is placed on the milling bed, squared up with the guide rail and passed through the saw blades.

The third saw blade 716 is provided to eliminate the need for the plank supplier to finish the outboard edge 736 of the plank. This helps keep the cost of the planks low.

Figure 8:
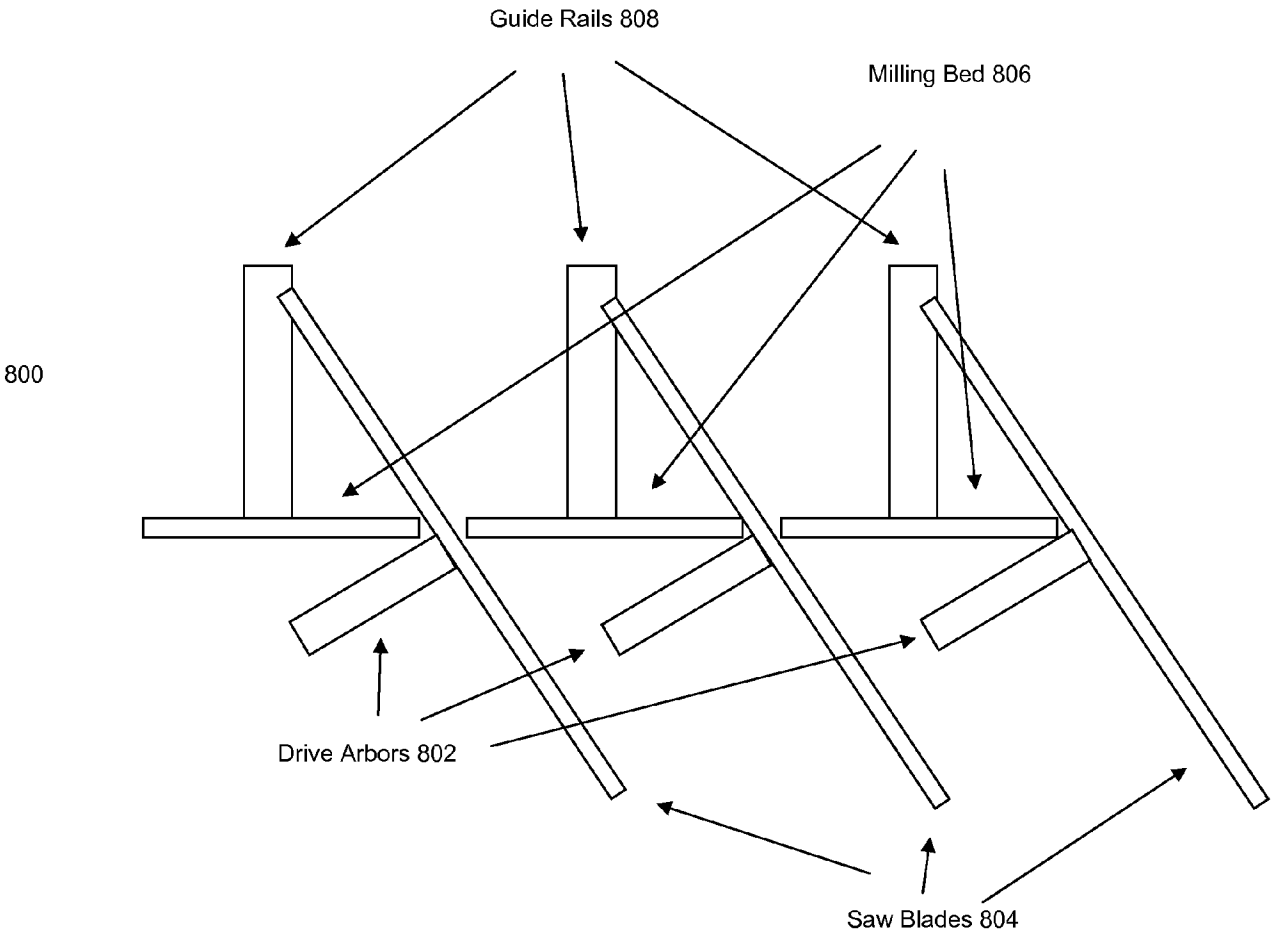
FIG. 8 shows a front view of a suitable saw apparatus for cutting multiple strips in parallel into wedges.

FIG. 8 illustrates a saw 800 for cutting three strips in parallel into wedges.

Three saw blades 804 are set at the appropriate angle and driven by three arbors 802. Each of the three strips (not shown) is placed on end resting on the milling bed 806 and squared up against its respective guide rail 808. The strips are then passed through the saw blades.

Figure 9:
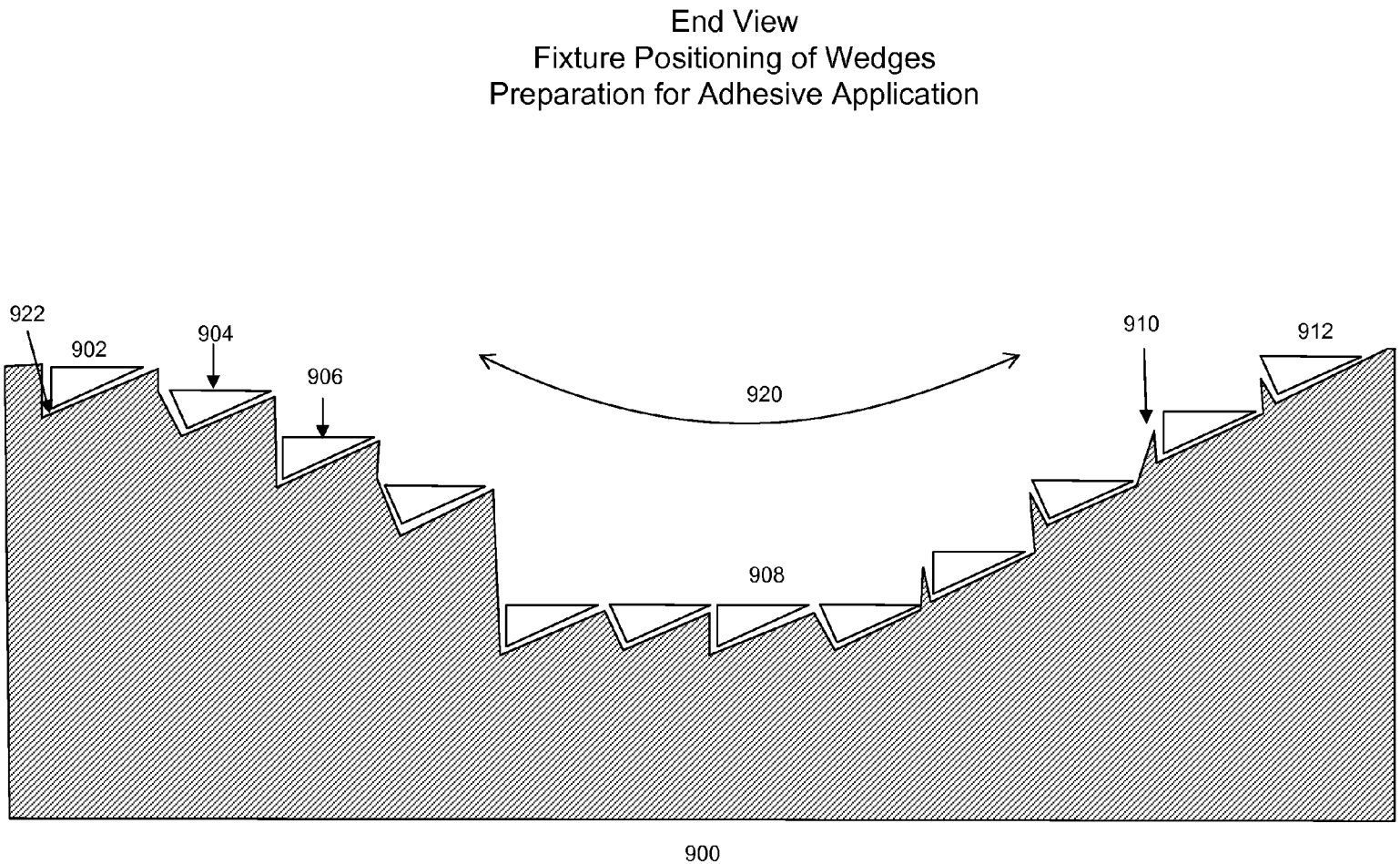
FIG. 9 shows a jig suitable for orienting a set of twelve wedges for the application of glue.

FIG. 9 shows an end view of jig 900 used to position the wedges for application of glue. All surfaces to be glued have been previously sanded smooth.

Each wedge 902 is placed its appropriate spot 922. Alternate wedges have either their hypotenuse 904 facing up or their major face 906 facing up. The wedges are arranged in stadium fashion 920 so that the outboard wedges 912 have a comparable distance to travel as the inboard wedges 908 when the glue covered wedges are assembled into a billet.

One side of the jig may comprise stops 910 to keep the wedges from sliding down.

Figure 10:
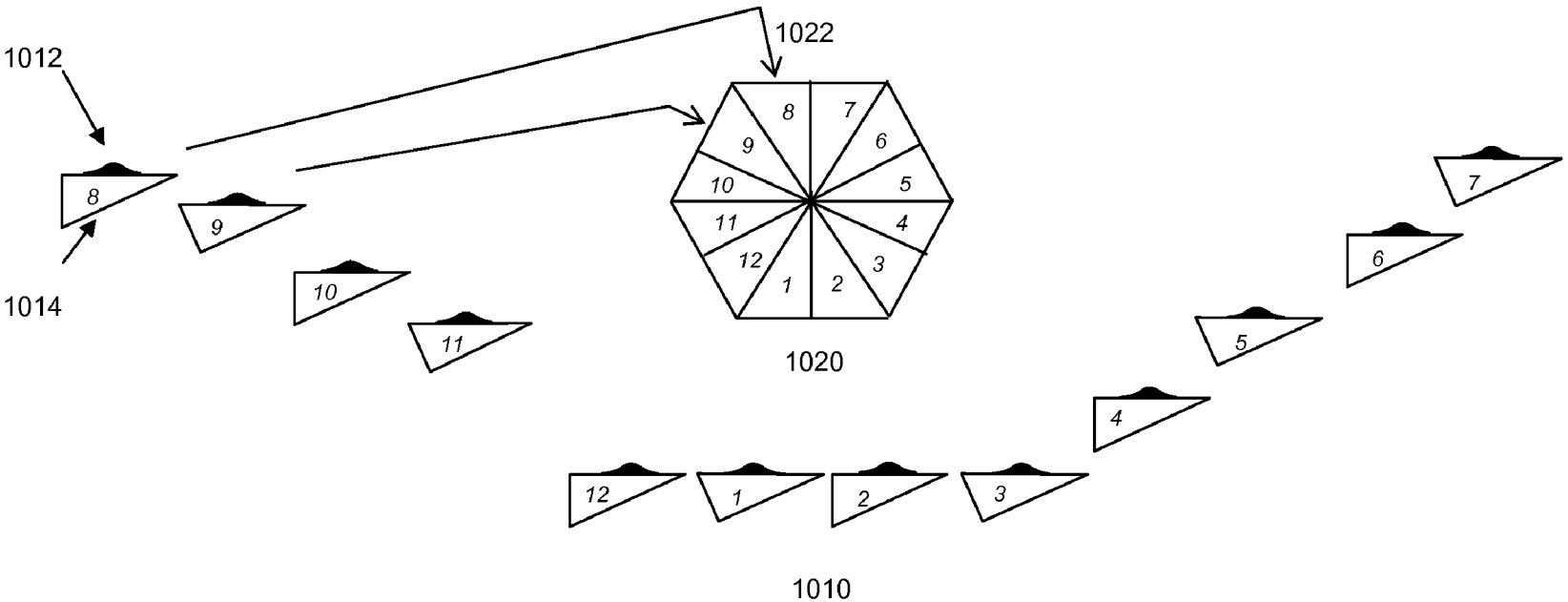
FIG. 10 shows twelve wedges in an initial "stadium" orientation with glue applied and in their final orientation after they have been moved to form a hexagonal billet.

FIG. 10 shows a set of wedges 1010 after glue beads 1012 have been applied. Each wedge is labeled with an italic number.

As discussed above, it has been found that glues with a low viscosity and hence fast rate of spread on the surface with their respective wedges produce bats with less of a tendency to split in the handles that glues with high viscosity.

After the glue has been applied, each wedge 1014 is moved and rotated, if necessary, into its final position 1022 to form billet 1020. The billet is then clamped and the glue is allowed to set.

Mechanical clamps may be used. Superior results, whoever, may be obtained by using a hydroforming type die or other hydrostatic clamp that produces a uniform pressure of at least 20 psig on the billet.

FIGS. 11A to 11D illustrate an assembly mechanism 1100 for holding the wedges in position for glue application and then subsequently moving them to form a billet.

Figure 11D:
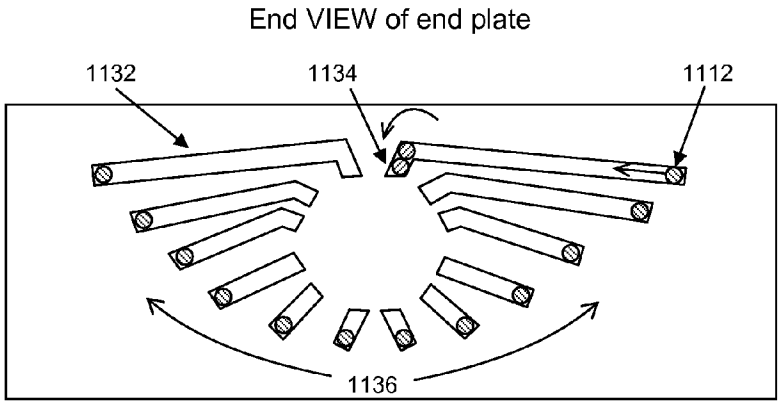
FIGS. 11A to 11D illustrate suitable equipment for holding wedges during glue application and subsequently moving them into position for clamping and setting of the glue.
Figure 11A:
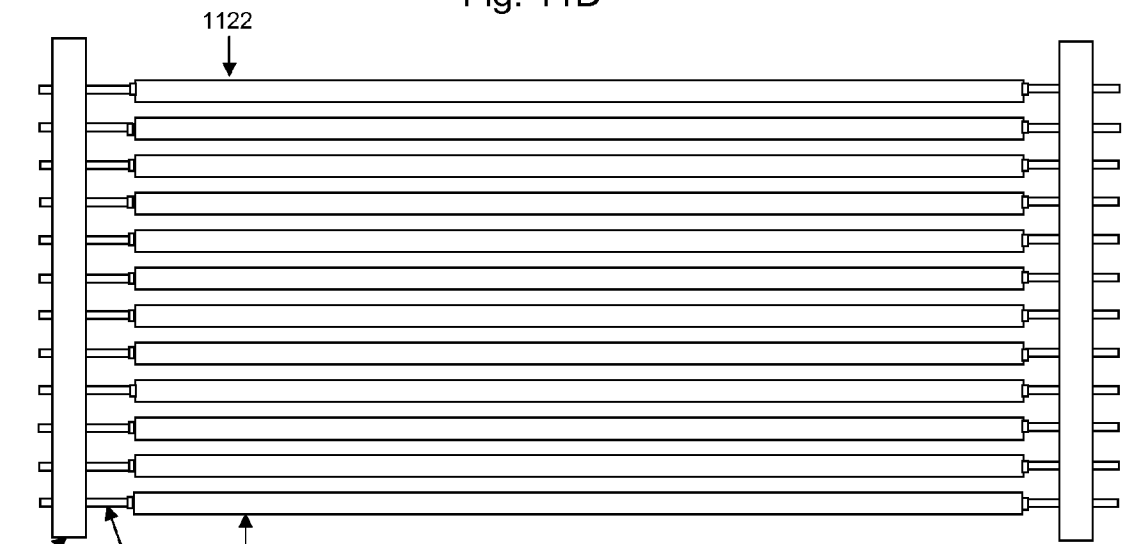

Referring to FIG. 11A, the alternative mechanism comprises end plates 1106 and wedge pins 1104. The wedge pins hold their respective wedges 1102 in position.

Figure 11C:
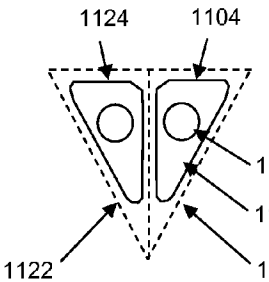
Figure 11B:
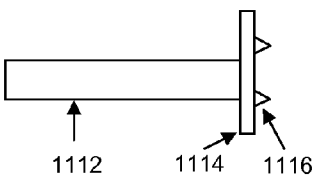

Referring to FIG. 11B, a wedge pin may comprise a shaft 1112, end plate 1114 and two or more positioning spikes 1116. The wedge positioning spikes are pressed into the end of a given wedge to hold it and rotate it as indicated below.

FIG. 11C shows two wedge pins 1104 and 1124 holding two wedges 1102 and 1122 back-to-back as they would be oriented in a billet.

FIG. 11D shows an end plate with milled channels 1132. Each wedge pin shaft 1112 is positioned in its respective milled channel. The stadium configuration 1106 is for the application of the glue to the wedges. After glue is applied to each wedge, the wedge pins are moved according to their respective channels, rotated if necessary, and then placed into final position 1134 to form the billet.

The billet is then clamped and removed. The wedge pins are then returned to their stadium positions and a new set of wedges is loaded.

The entire assembly mechanism 1100 can be housed in a temperature controlled chamber. This would be beneficial if a high temperature adhesive were used. For the above referenced 3M adhesive, for example, the temperature controlled chamber can be kept at the working temperature of the adhesive, 250° F.

EXAMPLE

A bat was made according to the process described herein. The bat was made out of maple with twelve wedges. The glue was Gorilla glue. The bat was subjected to 200 hits in a batting cage at a ball speed of 79 mph. The hits were made in every orientation of the bat as well as with contact off of the end of the bat and along the throat and near the handle of the bat. There was no visible wear and tear on the bat during this test. Moreover, the bat did not create any vibrations which could be felt against the bare hands of the tester. There was no stinging during any hit.

CONCLUSION

While particular embodiments of the present invention have been illustrated and described, it would be obvious to those skilled in the art that various other changes and modifications can be made without departing from the spirit and scope of the invention. Any of the aspects of the invention of the present invention found to offer advantages over the state of the art may be used separately or in any suitable combination to achieve some or all of the benefits of the invention disclosed herein.

I claim:

1. A method for manufacturing a laminated wooden baseball bat, said bat having a length, diameter and drop number, said method comprising the steps of:

a. selecting a plank of wood that is select grade or better, said plank having a length equal to or greater than said bat length, b. cutting said plank into one or more strips, said one or more strips having a width equal to or greater than said bat diameter;

c. cutting said one or more strips on a diagonal to form two wedges per strip wherein each of the two wedges is a right triangle;

d. matching the pair of wedges from at least one of said strips;

e. applying glue to at least one side of each wedge;

f. forming said wedges into a billet such that said matching pair of wedges is oriented back-to-back, g. applying pressure to said billet until said glue sets.

2. The method of claim 1, wherein the number of said wedges is twelve.

3. The method of claim 1, wherein the end grain of each of said wedges forms an angle of at least thirty degrees with respect to its minor side.

4. The method of claim 1, wherein said wood is one of maple, hickory or ash.

5. The method of claim 1, wherein said glue is a polyurethane adhesive.

6. The method of claim 1, wherein said glue has a viscosity of 600,000 cps or less at the temperature it is applied at.

7. The method of claim 1, wherein said glue has a viscosity of 14,000 cps or less at the temperature it is applied at.

8. The method of claim 1, which further comprises milling said billet into the final form of said bat such that the drop number is 5 or greater.

9. The method of claim 1, wherein the right triangle has a minor angle of about 30° and a major angle of about 60°.

10. The method of claim 1, wherein the right triangle has a minor angle and a major angle of about 45°.

11. The method of claim 1, wherein the right triangle has a minor angle of about 23.5°.

12. The method of claim 9, wherein the step of matching the pair of wedges from at least one of said strips further comprises flipping and rotating one wedge in each pair of wedges.

13. The method of claim 1, wherein the pair of wedges are matched such that a back end grain of one wedge is adjacent a front end grain of the other wedge.

14. The method of claim 1, wherein the pair of wedges are matched such that a major face of one wedge is adjacent a major face of the other wedge.

* * * * *